US010731933B2

(12) United States Patent
Streshinsky

(10) Patent No.: US 10,731,933 B2
(45) Date of Patent: Aug. 4, 2020

(54) HANDGUN WITH A LOCKING DEVICE

(71) Applicant: ARSENAL FIREARMS FINANCE LIMITED, British Virgin Islands (GB)

(72) Inventor: Dimitry Streshinsky, Paris (FR)

(73) Assignee: ARSENAL FIREARMS FINANCE LIMITED, British Virgin Islands (GB)

( * ) Notice: Subject to any disclaimer, the term of this patent is extended or adjusted under 35 U.S.C. 154(b) by 8 days.

(21) Appl. No.: 16/094,671

(22) PCT Filed: Apr. 20, 2016

(86) PCT No.: PCT/IB2016/052242
§ 371 (c)(1),
(2) Date: Oct. 18, 2018

(87) PCT Pub. No.: WO2017/182843
PCT Pub. Date: Oct. 26, 2017

(65) Prior Publication Data

US 2019/0128626 A1 May 2, 2019

(51) Int. Cl.
*F41A 3/44* (2006.01)
*F41A 5/02* (2006.01)

(52) U.S. Cl.
CPC . *F41A 3/44* (2013.01); *F41A 5/02* (2013.01)

(58) Field of Classification Search
CPC ..... F41A 3/44; F41A 3/36; F41A 3/46; F41A 5/02
See application file for complete search history.

(56) References Cited

U.S. PATENT DOCUMENTS 4,461,203 A 7/1984 Jawdat
4,915,011 A * 4/1990 Smith ..... F41A 17/42 89/176

(Continued)

FOREIGN PATENT DOCUMENTS

DE 19645681 A1 5/1998
WO 2013014656 A1 1/2013

OTHER PUBLICATIONS

International Search Report and Written Opinion for PCT/IB2016/052242 dated Sep. 13, 2016.

*Primary Examiner* — J. Woodrow Eldred
(74) *Attorney, Agent, or Firm* — Thomas | Horstemeyer, LLP

(57) ABSTRACT

Gun (1) comprising a gun frame (2); a barrel (4), supported by the gun frame (2), proximally delimiting a firing chamber (6) extending along a longitudinal axis (X); a slide (8), translatable longitudinally in relation to the barrel (4) between a forward configuration wherein the slide closes the firing chamber (6), and a rearward configuration wherein it is distanced from a proximal mouth (12) of the firing chamber (6), to open the latter; wherein orientation of said chamber (6) is substantially parallel to said axis (X) in the forward configuration and in the rearward configuration; and a locking device (10) mechanically locking barrel (4) and slide (8) to each other in the forward configuration, and that in the rearward configuration is guided transversally in relation to the barrel (4) for unlocking the slide (8). Slide (8) and locking device (10) delimit arched locking surfaces (14, 16) that in the forward configuration are coupled with each other for locking the slide (8), and that in the rearward configuration are mutually spaced in a transversal direction for opening said chamber (6).

16 Claims, 4 Drawing Sheets

(56) References Cited

U.S. PATENT DOCUMENTS

| | | | | |
|---|---|---|---|---|
| 9,546,831 | B2 * | 1/2017 | Bandini | F41A 3/44 |
| 10,018,433 | B2 * | 7/2018 | Tuason | F41A 3/46 |
| 2008/0034955 | A1 * | 2/2008 | McGarry | F41A 3/86<br>89/196 |
| 2019/0128626 | A1 * | 5/2019 | Streshinsky | F41A 5/02 |

* cited by examiner

HANDGUN WITH A LOCKING DEVICE

CROSS-REFERENCE TO RELATED APPLICATION

This application is the 35 U.S.C. § 371 national stage application of PCT Application No. PCT/IB2016/052242, filed Apr. 20, 2016, which is herein incorporated by reference in its entirety.

The present invention relates to a gun, preferably of the (semi-)automatic type.

Document WO2013/014656A1 of the same applicant discloses a "short recoil" gun according to the preamble of claim 1.

It has been observed that devices manufactured according to the teaching of WO2013/014656A1 suffer of some drawbacks.

Mentioning one of the downsides in particular, the bifurcated arms of the locking device therein disclosed are provided with tab-like locking projections that, due to the repeated recoiling forces, get progressively deformed.

As a consequence, after many firing cycles, sliding of such projections along corresponding slide riflings becomes more difficult, and the useful life of such firearm drastically shortens.

As a consequence, the present gun with its improved locking system sets out to resolve the aforementioned problems, in particular by proposing a gun with a locking device more resistant to recoiling forces, mainly by virtue of the wide contact surfaces between the mechanical parts.

Such objective is achieved by a gun according to claim 1, and by a gun according to claim 17. The dependent claims show preferred embodiment variations.

The present invention will now be described in detail, with the help of the attached drawings, wherein.

Figure 1:
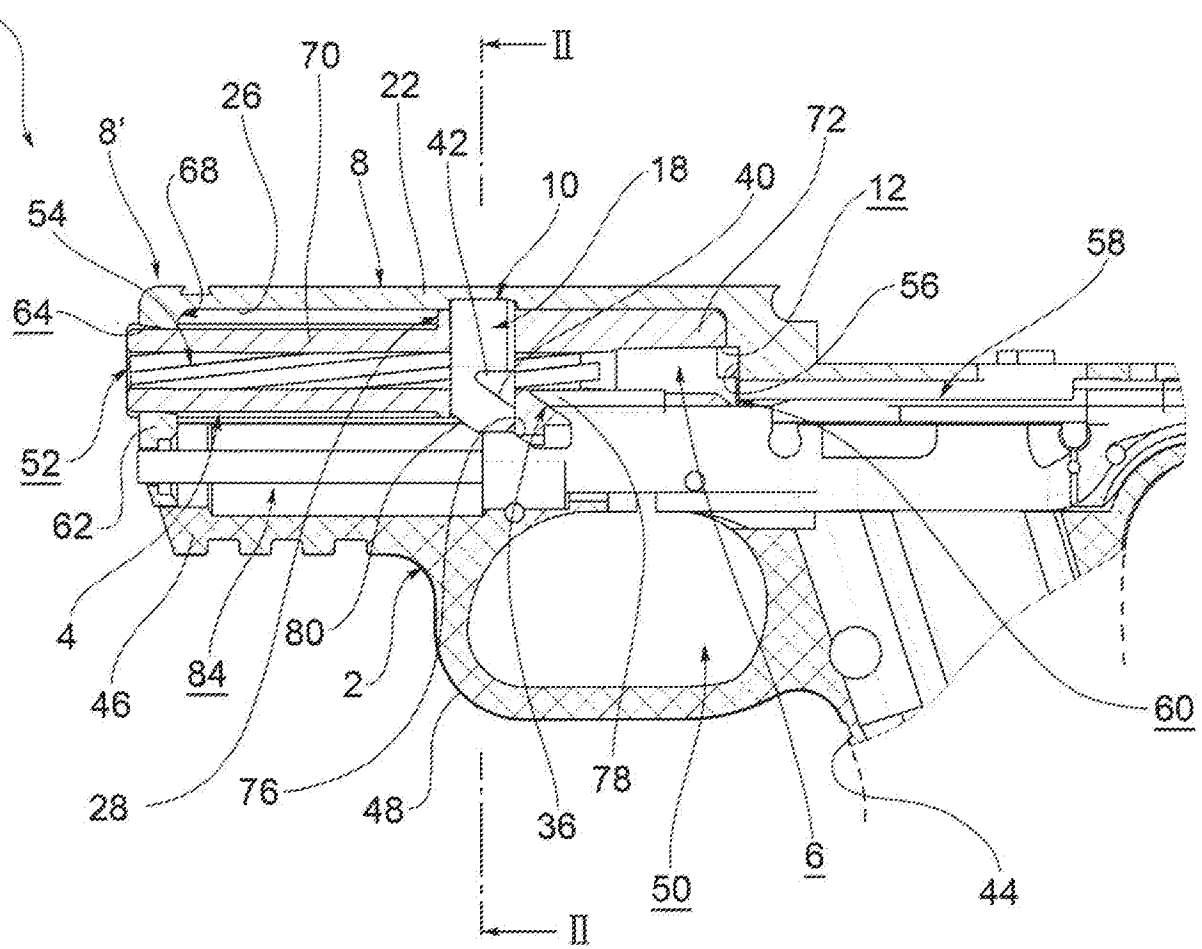
FIGS. 1 and 3 show partially cross-sectioned side views of a gun according to the present invention, during different firing phases of the weapon.

With reference to the aforesaid drawings, reference numeral 1 globally denotes a gun. Preferably, such gun is a semi-automatic, advantageously short recoil, gun.

According to a particularly advantageous variant, such gun is of the automatic type, therefore suitable for firing volleys of bullets.

The gun 1 comprises a gun frame 2 and a barrel 4, supported by the gun frame 2, advantageously in a movable manner so as to allow the barrel to recoil.

According to an embodiment, the gun 1 comprises a trigger (omitted from the drawings) mounted to the frame 2 in a rotatable or translatable manner.

In a further embodiment, the gun frame 2 comprises a gripping portion 44, preferably ergonomically shaped in relation to a user's hand.

In yet a further embodiment, the gun frame 2 comprises a support wall 46, connected to the gripping portion 44 and which extends distally from it.

Again according to the variation shown, the gun frame 2 comprises a trigger guard 48 which extends from the support wall 46 to the gripping portion 44, advantageously made in one piece with the aforesaid wall 46 and the aforementioned portion 44. The trigger is advantageously housed within an inner space 50 delimited by the trigger guard.

Within this patent specification, the term "proximal" will be taken to mean the components of the gun positioned near or towards the gripping portion 44; vice versa, the term "distal" will be used to indicate the components positioned towards a weapon's muzzle 52.

As far as the structure of the barrel 4 is concerned, it proximally delimits a firing chamber 6 extending along a longitudinal axis X. Such chamber is configured for at least partially housing a cartridge.

The barrel 4 distally opens towards the muzzle 52, and advantageously delimits an internal rifling 54, for example clockwise- or anticlockwise-oriented.

The gun further comprises a slide 8 slidable/translatable longitudinally in relation to the barrel 4 between a forward configuration wherein the slide closes the firing chamber 6, and a rearward configuration wherein slide 8 is distanced from a proximal mouth 12 of the firing chamber 6, to open the latter.

Figure 3:
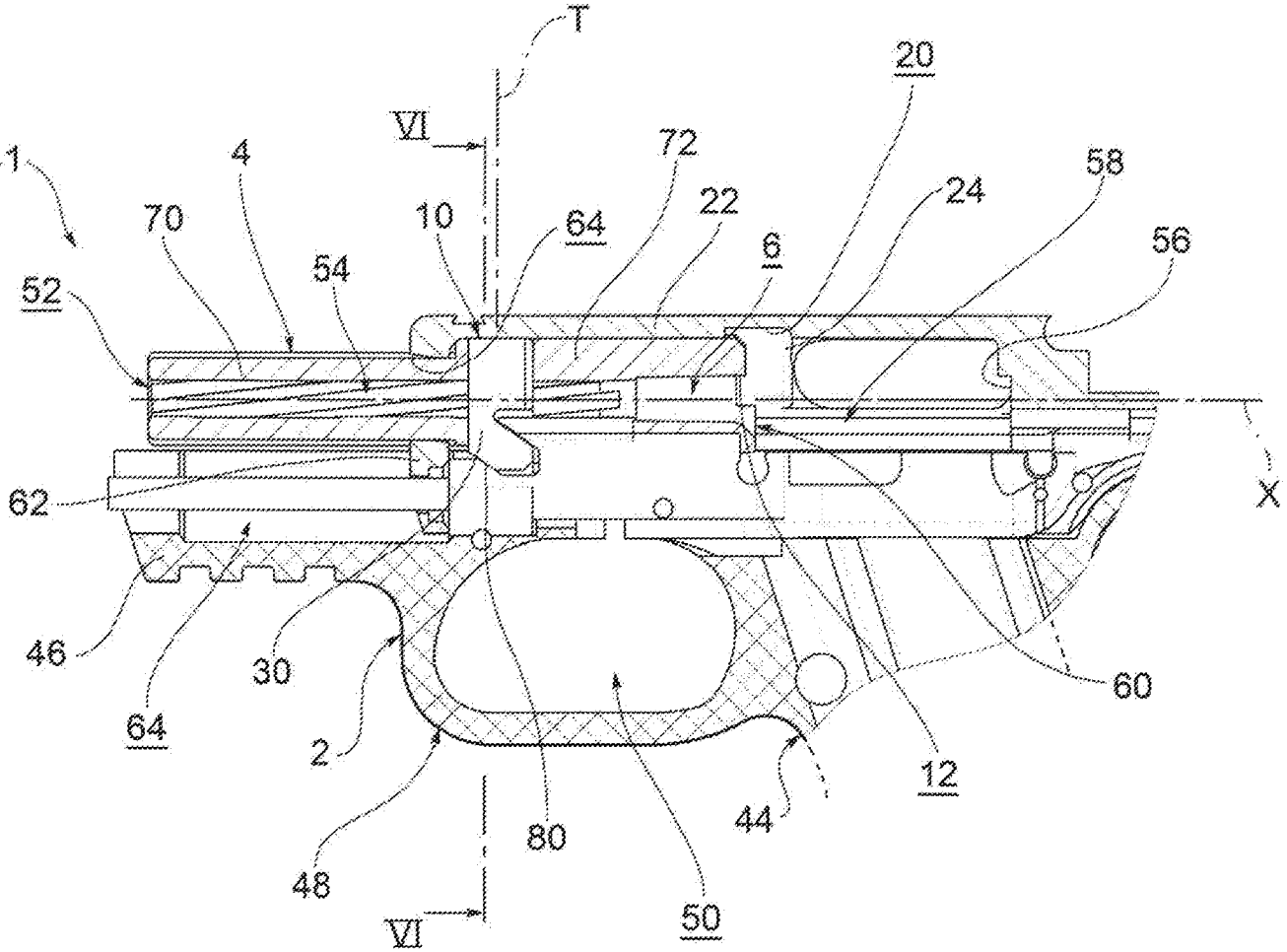
Figure 4:
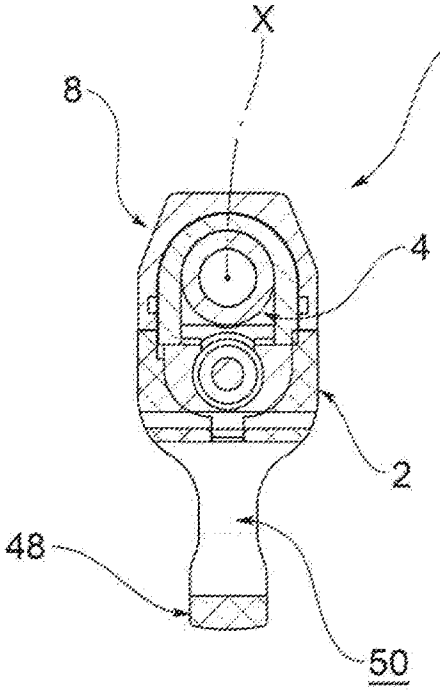

As a consequence, in the forward configuration, the proximal mouth 12 of the barrel 4 is occluded by the slide 8 to close the firing chamber 6; in particular, in such configuration an inner wall 56 of the slide 8 at least partially overlaps the proximal mouth of said chamber. Conversely, in the rearward configuration (as e.g. shown in FIG. 3), the slide moves on and in relation to the frame 2 proximally ("backwardly") in relation to the forward configuration, so that the inner wall 56 positions itself at a certain distance from the mouth 12 of the firing chamber 6; in this configuration, the firing chamber is open.

Orientation of the firing chamber 6 is substantially parallel to said longitudinal axis X in the forward configuration and in the rearward configuration.

In other words, when the barrel undergoes the recoil produced by the shot, it translates for a brief stroke proximally, joined to the slide 8 (see for reference the barrel position in FIG. 1 and in FIG. 3), keeping its orientation; this way, at each firing phase the barrel remains straight and in line, and any inclination or tipping thereof is avoided.

Preferably, in the previously mentioned forward and rearward configurations, the orientation of the barrel is substantially coincident with the longitudinal axis X.

According to an embodiment, the gun comprises a firing pin (not shown) movable towards the firing chamber 6 by means of a (nor shown) firing device activated by the trigger. E.g. the firing could be performed with a firing device comprising a floating firing pin, or with a hammer-operated firing pin.

Advantageously, the firing pin is housed so as to be movable longitudinally in a seat 58 made proximally in the slide 8. According to one variation, the firing pin crosses the inner wall 56 of the slide 8 (through a pin opening 60), thereby being configured to project towards the firing chamber 6.

Preferably, slide 8 is mounted in a slidable manner on (and with respect to) the barrel 4, in particular in a substantially parallel direction to the longitudinal axis X. For example, a distal wall 62 of the slide 8 is traversed by a barrel hole 64 engaged by the barrel in a translatable manner.

Gun 1 further comprises a locking device 10 mechanically locking barrel 4 and slide 8 to each other in the forward configuration, and that in the rearward configuration is guided transversally to the barrel 4 for unlocking the slide 8.

In other words, in the forward configuration locking device 10 secures barrel and slide, in particular in order to make them together. Conversely, in the rearward configuration, locking device 10 releases slide 8 to enable an independent (proximal or backward) movement thereof, to open the firing chamber 6.

Figure 2:
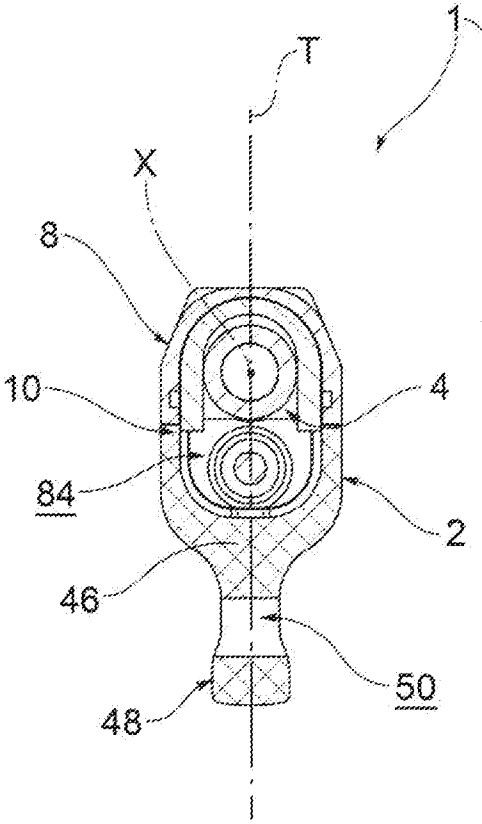
FIGS. 2 and 4 are transversal cross-sections corresponding to the functioning phases of FIGS. 1 and 3, along the lines II-II and IV-IV of the latter figures.

It is herewith pointed out that, in the present description, the term "transversal" will be intended to mean a direction incident or orthogonal to the longitudinal axis X. See e.g. the direction Y schematized in FIG. 2 or 7.

Preferably, locking device 10 is guided along a substantially rectilinear trajectory.

According to a preferred embodiment, the locking device 10 is joined in translation to the barrel 4 (in a longitudinal direction), although with a freedom of movement in a said transversal direction T.

Advantageously, the locking device 10 is engaged with the barrel 4 distally to the firing chamber 6, preferably in a position between the aforesaid chamber and the muzzle 52.

According to the invention, slide 8 and locking device 10 delimit arched locking surfaces 14, 16 that in the forward configuration are coupled with each other for locking the slide 8, and that in the rearward configuration are mutually spaced (preferably at least in said transversal direction T) for unlocking the slide and opening said chamber 6.

As a consequence, the contact surfaces 14, 16 between slide 8 and locking device 10 are more extensive in relation to the prior art solutions, and are preferably at least partially allocated around barrel 4.

According to a preferred embodiment, one or both said arched locking surfaces 14, 16 at least partially enclose barrel 4.

E.g. the arched locking surfaces 14, 16 extend along planes that are incident, preferably orthogonal, to the longitudinal axis X.

According to another preferred embodiment, in the rearward configuration, the arched locking surfaces 14, 16 are mutually directed in opposite directions. More precisely (see e.g. FIG. 3), a first arched locking surface 14 of the slide 8 faces proximally, while a second arched locking surface 16 of the locking device 10 is directed distally.

Preferably, the locking device 10 comprises a shaped body 18, delimiting one 16 of said arched locking surfaces.

According to the shown embodiments, shaped body 18 is substantially U-shaped.

Advantageously, the locking device 10 comprises a bent, originally straight, shaped body 18.

According to a further embodiment, in the forward configuration, the shaped body 18 that is at least partially housed in a recessed locking seat 20, partially extending in the thickness of a top wall 22 of the slide 8.

More precisely, top wall 22 delimits a bowed seat surface 24 (that delimits said seat 20 on one side), directed towards the gun frame 2 and shape-coupled to said body 18 in the forward configuration.

According to a further embodiment, slide 8 internally delimits a concave, preferably half-tubular, gliding surface 26 that in the rearward configuration is in a gliding contact with the firing chamber 6, in particular with a top surface 66 thereof.

According to another embodiment, the bowed seat surface 24 and the half-tubular gliding surface 26 extend around parallel (and preferably non-coincident) surface axes. The radiuses of curvature of bowed seat surface 24 and of the half-tubular gliding surface 26 could be identical or dissimilar to each other.

Preferably, the above-mentioned surfaces 24, 26 are radially divided by a first arched locking surface 14 delimited by the slide 8.

According to a variation, distally to the locking device 10, the barrel 4 comprises a radial projection or a radial lip 28 that extends towards the slide 8. Such projection/lip interacts with the locking device 10, to move the latter from the forward to the backward configuration.

Figure 7:
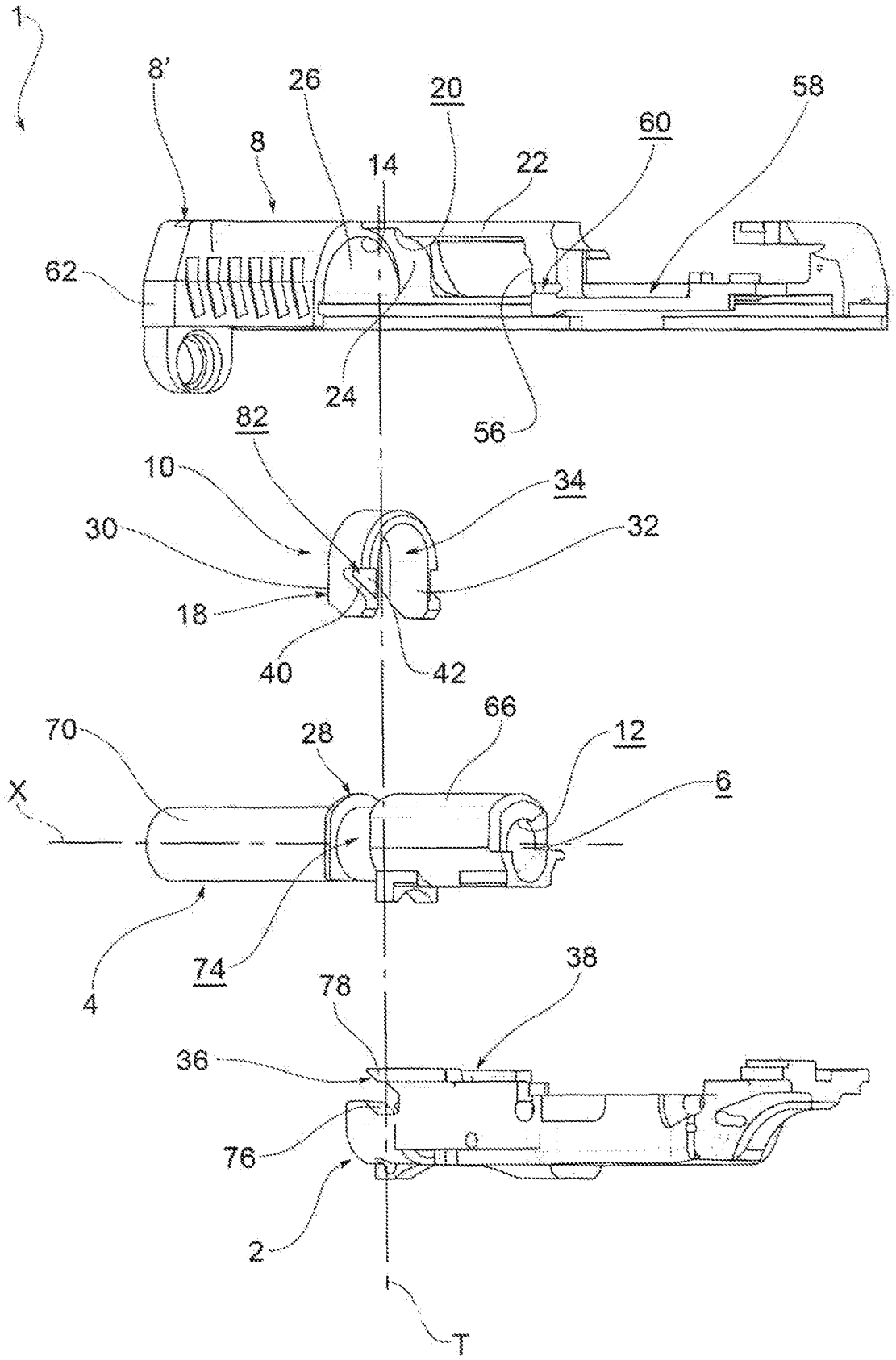
FIG. 7 shows an exploded, perspective view of the locking system which the present invention relates to, according to a possible variant.

As shown for example in FIG. 7, the radial projection or radial lip 28 extends away from a tubular body 70 of the barrel 4.

Preferably, the radial projection or radial lip 28 and a thickened wall 72 of the barrel 4 (that in particular delimits the firing chamber 6) are axially distanced from each other to define a seat 74 to house the locking device 10 in a slidable manner.

Preferably, the radial projection or radial lip 28 makes an end-stroke for the slide during its proximal or backward movement in the rearward configuration. More precisely, said projection/lip is aligned in a direction substantially parallel to the longitudinal axis X with an abutment tooth 68 of the slide 8, so as to contact with the projection/lip.

Abutment tooth 68 is preferably positioned at the distal wall 62.

Abutment tooth 68 is shaped complementary to a portion of the barrel, according to an embodiment.

Advantageously, abutment tooth 68 is preferably shaped complementary to a portion of the barrel.

According to an advantageous embodiment, abutment tooth 68 delimits part of the barrel hole 64.

The locking device 10 preferably comprises device arms 30, 32 which define between them a recess 34 for housing a section (e.g. a proximal section) of the barrel 4.

According to a preferred variant, the arms 30, 32 are of sufficient length to prevailingly contain the core of the barrel; within this context, the term "prevailingly" is understood to mean that the arms define a recess having a depth at least equal to, or greater than, 85% of the outer diameter of the barrel.

Figure 5:
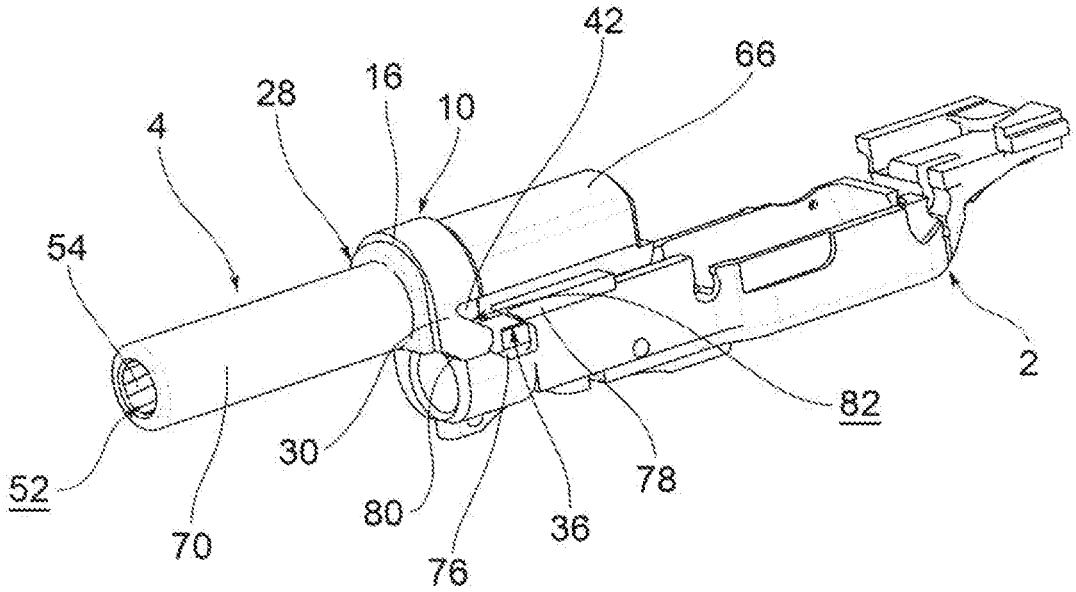
FIGS. 5 and 6 illustrate a frame, a barrel and a locking device of the present invention, respectively in a forward and in a rearward configuration, wherein the slide has been omitted for improving the clarity.
Figure 6:
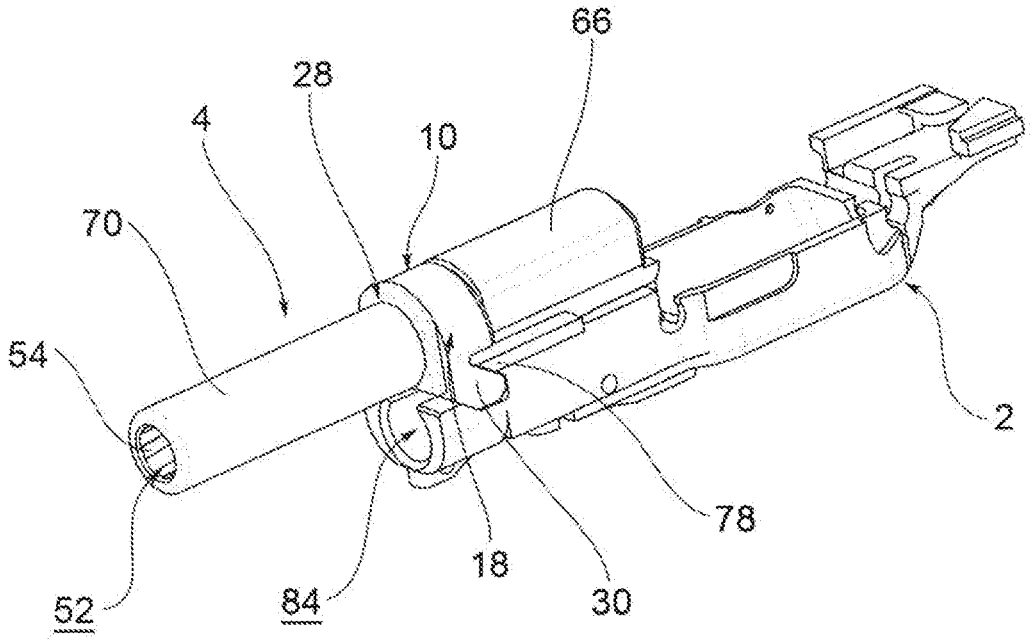

According to the embodiments shown in FIG. 5 or 6, the gun frame 2 comprises one or more guiding elements 36, 38 that project towards at least one of said arms 30, 32 to intercept and deviate the latter, in order to distance the locking device 10 from the slide 8.

In other words, the above guiding elements 36, 38 interact with one or both said arms to guide the locking device 10 from the forward configuration to the backward configuration.

E.g. at least a guiding element 36, 38 comprises a pointed portion 78, directed towards the device arm 30, 32.

Preferably, the opposite movement of locking device (from the backward to the forward configuration) is performed by means of at least a second cam surface 76 delimited by the gun frame 2, that contacts one or both said arms 30, 32 (more precisely a distal surface 80 thereof).

According to an advantageous embodiment, at least one of said device arms 30, 32 comprises a first cam surface 40 for promoting a transversal translation of the locking device 10 with respect to the barrel 4.

According to another embodiment, at least a device arm 30, 32 delimits in its thickness the first cam surface 40, directed towards the guiding element 36, 38.

According to a particularly preferred embodiment, one or both device arms 30, 32 overlap at least partly one or both guiding elements 36, 38 in a transversal direction so that, in the rearward configuration, an arm surface 42 remains internally to said element to reduce or prevent divarication of said arms 30, 32 of the locking device 10.

In the shown embodiments, the first cam surface 40 and said arm surface 42 extend along reciprocally incident planes, so as to delimit an arm cavity 82 engageable by the guiding element 36, 38, preferably by the pointed portion 78 thereof.

According to a non-illustrated variation, the locking device 10 comprises at least a sliding projection that, in the rearward configuration, engages in a slidable manner a longitudinal rifling of the slide.

Preferably, the sliding projection is positioned on at least one of said device arms, and preferably comprises a fin substantially parallel to the longitudinal axis X.

Merely by way of example, the functioning of the gun described will now be illustrated.

In an initial phase, a cartridge (not shown) is found to be inserted in the firing chamber 6 and the relative position of the gun frame 2, the barrel 4 and the slide 8 is as shown in FIG. 1: a distal end of the slide 8' is substantially aligned with the free portion of the support wall 46 and is kept in such position by the action of a recovery spring (not shown) housed in a spring seating 84 between the barrel 4 and the gun frame 2. Such spring is initially in an extended configuration.

Barrel 4 and slide 8 are joined by locking device 10 because the latter is housed in, and geometrically coupled to, the locking seat 20 of the slide 8. In this position the arched locking surfaces 14, 16 contact each other, and the guiding elements 36, 38 are preferably distanced from the device arms 30, 32.

When the trigger is pulled and the cartridge fuse is exploded by the firing pin, a bullet comes out distally from the muzzle 52, and the barrel, locking device and slide group recoil together for a certain (short) distance.

As a result of the combined movement of longitudinal translation of the barrel and the transversal movement of the locking device (performed through an interaction between the first cam surfaces 40 and the guiding elements 36, 38), the locking device 10 is guided at a distance from slide 8.

As a consequence, the arched locking surfaces 14, 16 become spaced from each other, and uncoupled. In this way, the slide is released from the barrel, which has reached an end stroke. The orientation of the firing chamber 6 has remained substantially coincident with the longitudinal axis X, because the above spacing involved solely the locking device.

Subsequently, given that the pressure inside the firing chamber is sufficiently high to overcome the recall force of the recovery spring, the slide continues its rearward movement opening the firing chamber. During such backward movement, the firing chamber 6 contacts in a sliding manner the gliding surface 26 of the slide 8.

Lastly, when the pressure in the firing chamber falls below a predefined value such as to be overcome by the recall force of the recovery spring, which is now compressed, the slide inverts its movement direction, heading distally, restoring the configuration of the barrel and of the locking device of the initial position (FIG. 1). More precisely the position of the locking device is restored by means of the second cam surface 76 delimited by the gun frame 2, that contacts one or both the device arms 30, 32 and moves the device towards the slide.

In such configuration, the gun is ready for a new firing cycle.

The present invention also relates to a gun 1 comprising a gun frame 2, a barrel 4 supported by the gun frame 2, which proximally delimits a firing chamber 6 extending along a longitudinal axis X, a slide 8 and a locking device 10. The slide 8 is translatable longitudinally in relation to the barrel 4 between a forward configuration wherein the slide closes the firing chamber 6, and a rearward configuration wherein it is distanced from a proximal mouth 12 of the firing chamber 6, to open the latter. Orientation of the firing chamber 6 is substantially parallel to said axis X in the forward configuration and in the rearward configuration. The locking device 10 mechanically locks barrel 4 and slide 8 to each other in the forward configuration, and in the rearward configuration is guided transversally to the barrel 4 for unlocking the slide 8, said device 10 comprising device arms 30, 32 defining between them a recess 34 for housing a section of the barrel 4. Such said gun 1 being characterized in that one or both device arms 30, 32 overlap at least partly one or two guiding elements 36, 38 of the gun frame 2 in a transversal direction so that, in the rearward configuration, an arm surface 42 remains internally to said element(s) to reduce or prevent divarication of said arms 30, 32 of the locking device 10.

As far as advantageous or preferred embodiments of this second invention is concerned, reference is made to the previous description.

Innovatively the gun which the present invention relates to has a reduced wear compared to prior art weapons, because it offers broad contact surfaces between the gun components.

Innovatively, the gun which the present invention relates to suffers a low divarication of the locking device, because at least an arm is prevented from undergoing deformation.

Advantageously, the gun which the present invention relates to is extremely well-balanced thereby maintaining a high level of shooting accuracy even in quick fire and even in firing volleys for some variants.

Advantageously, the locking system described makes it possible to reduce the overall dimensions of the firearm due to the rational positioning of the locking components.

Also, advantageously, the present gun allows to reduce the mechanical stresses between the moving parts.

Advantageously, in addition, the compact nature of the locking device and the relative position of the locking components make it possible to significantly reduce distance between the longitudinal axis and the point closest to the user's hand along the grip portion.

Advantageously, the kinematisms of the firing device are staggered in relation to the locking device; consequently, on the one hand their mutual interaction is prevented and on the other the dimensions of the gun transversally to the longitudinal axis X can be extremely limited.

Advantageously, the gun which the present invention relates to is suitable for being produced in an extremely economical manner.

Lastly, advantageously, the loading of bullets inside the firing chamber takes place substantially along the longitudinal axis; consequently, inside the magazine the bullets do not need to be kept with their ogives pointing upwards as in the prior art. On the contrary, such bullets penetrate the chamber substantially without interacting with the frame and/or with the mouth of the firing chamber. This makes it possible to avoid scraping during said insertion and therefore makes the present gun more reliable than the traditional weapons.

A person skilled in the art may make variations to the embodiments of the gun described above or replace elements with others functionally equivalent so as to satisfy specific requirements.

Such variations are also contained within the sphere of protection as defined by the following claims.

Moreover, each of the variants described as belonging to a possible embodiment may be realised independently of the other variants described.

The invention claimed is:

1. A gun comprising:

a gun frame;

a barrel, supported by the gun frame, which proximally delimits a firing chamber extending along a longitudinal axis;

a slide, translatable longitudinally in relation to the barrel between a forward configuration wherein the slide closes the firing chamber, and a rearward configuration wherein the slide is distanced from a proximal mouth of the firing chamber, to open the firing chamber; orientation of the firing chamber being substantially parallel to said axis in the forward configuration and in the rearward configuration;

a locking device mechanically locking the barrel and the slide to each other in the forward configuration, and that in the rearward configuration is guided transversally to the barrel for unlocking the slide;

said gun being characterized in that the slide and the locking device delimit arched locking surfaces that in the forward configuration are coupled with each other for locking the slide, and that in the rearward configuration are mutually spaced in a transversal direction for opening said firing chamber.

2. The gun according to claim 1, wherein, in the rearward configuration, the arched locking surfaces are mutually directed in opposite directions, a first arched locking surface of the slide facing proximally, a second arched locking surface of the locking device being directed distally.

3. The gun according to claim 1, wherein the locking device comprises a shaped body, delimiting one of said arched locking surfaces and that in the forward configuration is at least partially housed in a recessed locking seat, partially extending in the thickness of a top wall of the slide.

4. The gun according to claim 3, wherein said shaped body is substantially U-shaped, and wherein said top wall delimits a bowed seat surface, directed towards the gun frame and shape-coupled to said body.

5. The gun according to claim 4, wherein the slide internally delimits a half-tubular gliding surface that in the rearward configuration is in a gliding contact with the firing chamber.

6. The gun according to claim 5, wherein the bowed seat surface and the half-tubular gliding surface extend around parallel and non-coincident surface axes, said surfaces being radially divided by a first arched locking surface delimited by the slide.

7. The gun according to claim 1, wherein, distally to the locking device, the barrel comprises a radial projection or a radial lip that extends towards the slide, said lip making an end-stroke for said slide during its backward movement in the rearward configuration.

8. The gun according to claim 1, wherein the locking device comprises device arms which define between them a recess for housing a section of the barrel, wherein the gun frame comprises one or more guiding elements that project towards at least one of said arms to intercept and deviate the device arms, in order to distance the locking device from the slide.

9. The gun according to claim 8, wherein at least one of said device arms comprises a first cam surface for promoting a transversal translation of the locking device with respect to the barrel.

10. The gun according to claim 8, wherein at least a device arm delimits in its thickness a first cam surface directed towards the guiding element.

11. The gun according to claim 9, wherein one or both device arms overlap at least partly the one or more guiding elements in a transversal direction so that, in the rearward configuration, an arm surface remains internally to said guiding elements to reduce or prevent divarication of said arms of the locking device.

12. The gun according to claim 9, wherein the first cam surface and the arm surface extend along reciprocally incident planes, so as to delimit an arm cavity engageable by the guiding elements.

13. The gun according to claim 1, wherein the locking device comprises at least a sliding projection that, in the rearward configuration, engages in a slidable manner a longitudinal rifling of the slide.

14. The gun according to claim 13, wherein the sliding projection is positioned on at least one of said device arms, and preferably comprises a fin substantially parallel to the longitudinal axis.

15. The gun according to claim 1, wherein one or both said arched locking surfaces at least partially enclose the barrel.

16. The gun according to claim 1, wherein the locking device comprises a bent, originally straight, shaped body.

* * * * *